United States Patent [19]

Hattori

[11] Patent Number: 4,576,410

[45] Date of Patent: Mar. 18, 1986

[54] LUMBAR SUPPORT FOR A BACKREST

[75] Inventor: Takemi Hattori, Kariya, Japan

[73] Assignee: Aisen Seiki Kabushika Kaisha, Japan

[21] Appl. No.: 497,758

[22] Filed: May 25, 1983

[30] Foreign Application Priority Data

May 26, 1982 [JP] Japan ..... 57-88114

[51] Int. Cl.[4] ..... A47C 3/36

[52] U.S. Cl. ..... 297/284; 297/361

[58] Field of Search ..... 248/178–180, 248/274, 900; 403/166; 297/284, 354, 361

[56] References Cited

U.S. PATENT DOCUMENTS

| | | | |
|---|---|---|---|
| 1,004,476 | 9/1911 | Schultz | 248/145 |
| 1,182,881 | 5/1916 | Frye | 248/180 |
| 3,018,992 | 1/1962 | Lore | 248/180 |
| 4,040,661 | 8/1977 | Hogan | 297/284 |
| 4,162,807 | 7/1979 | Yoshimura . | |
| 4,295,681 | 10/1981 | Gregory | 297/284 |
| 4,313,637 | 2/1982 | Barley | 297/284 |

*Primary Examiner*—William E. Lyddane
*Assistant Examiner*—Joseph Falk
*Attorney, Agent, or Firm*—Finnegan, Henderson, Farabow, Garrett & Dunner

[57] ABSTRACT

Changes in the vertical inclination of a lumbar support plate pivotally mounted within a backrest cause different portions of the convex surface of the support plate to contact the back of the lumbar region of the backrest, vertically altering the site of support afforded by the plate. A cable transmits motion of user controls mounted on the outside of the backrest into incremental or continuous rotation of a circular cam. Cam followers on the rear of the support plate translate cam rotation into changes in support plate inclination. The disclosed mechanism is employable simultaneously with controls for rendering the support plate adjustable also in the horizontal direction.

14 Claims, 7 Drawing Figures

Fig. 1
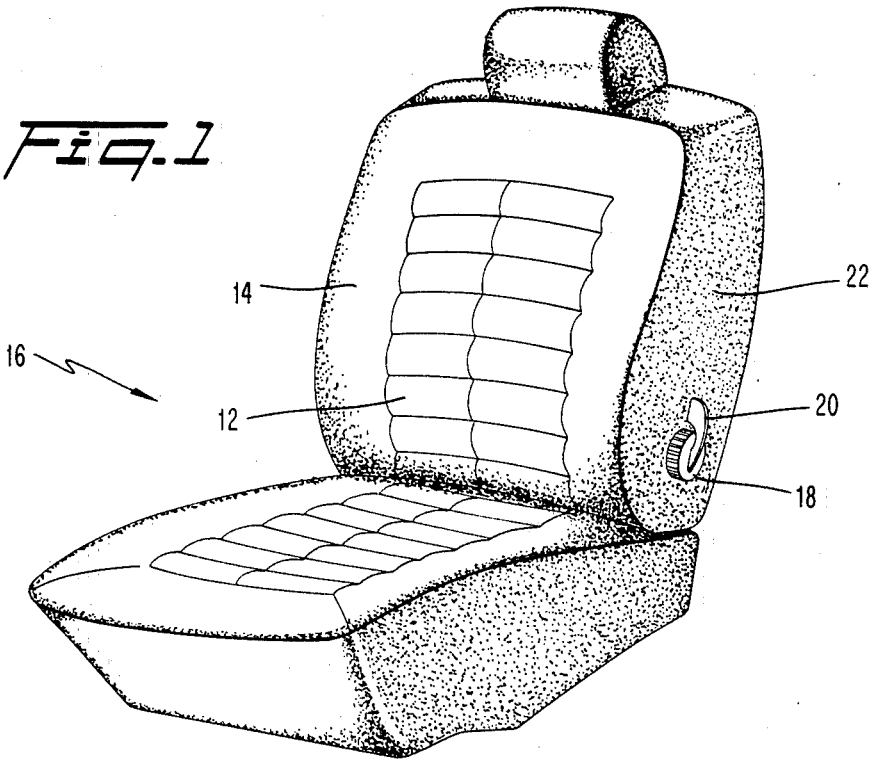
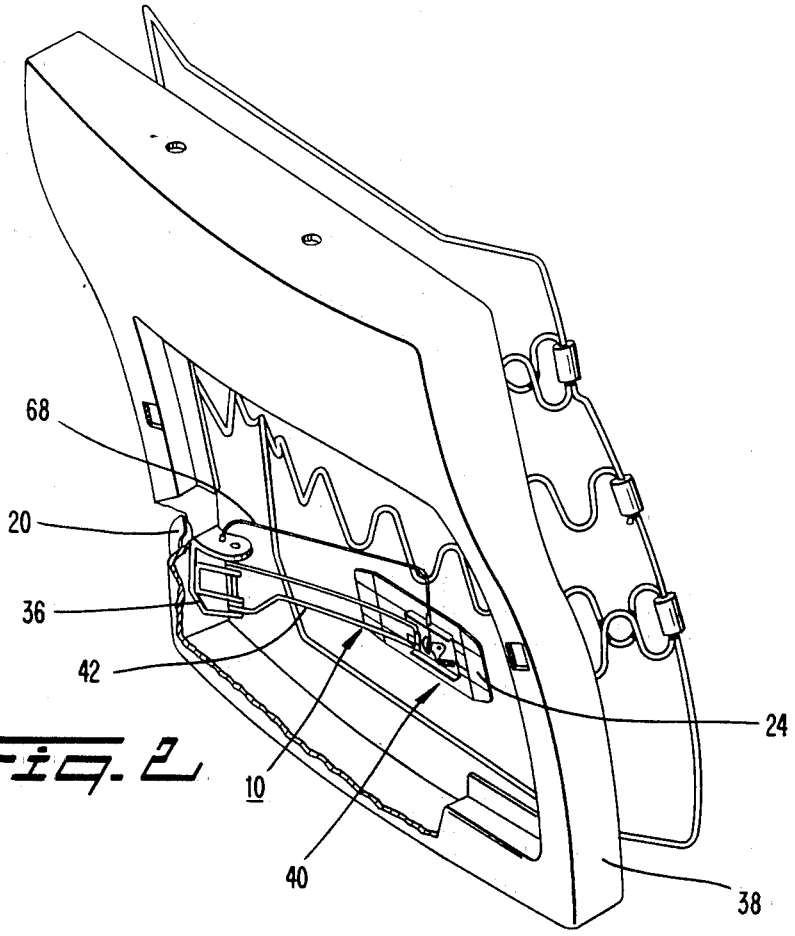
Fig. 2

Fig. 6
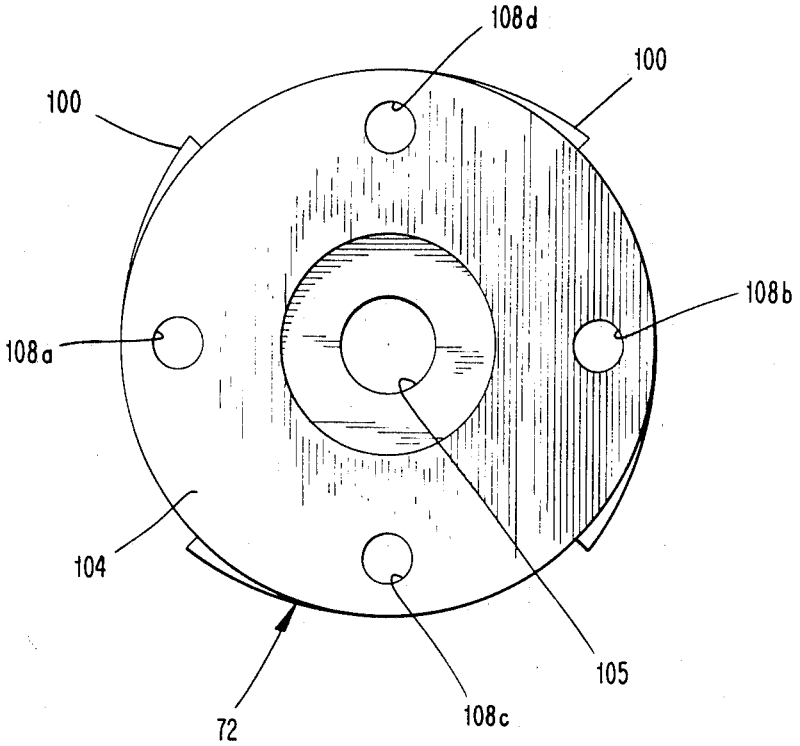
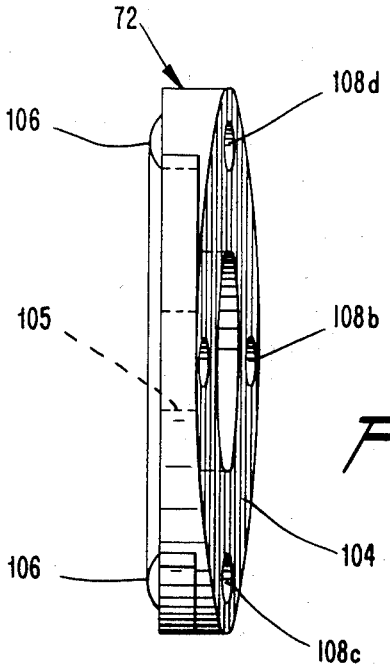
Fig. 7

LUMBAR SUPPORT FOR A BACKREST

BACKGROUND OF THE INVENTION

1. Field of the Invention

This invention relates to a lumbar support, and more particularly to an adjustable lumbar support for a backrest.

2. Background Art

In an adjustable lumbar support for a backrest, a cam member is rotated by a lever mounted on the backrest. As a result, a support plate within the backrest is moved in a horizontal direction normal a plane generally defined by the backrest using a torsion member cooperating with the cam member. Horizontal adjustment of the position of the support plate permits regulation of the degree of pressure the support plate exerts on the back of the portion of the backrest designed to be aligned with the lumbar region of a user, thereby reducing back fatigue. Such an adjustable lumbar support for a backrest is disclosed in applicant's U.S. patent application Ser. No. 6/480,574, filed Mar. 30, 1983.

In the lumbar support described above, regulation of the height at which the support plate presses against the back of the backrest is conventionally not available. Nevertheless, there are height differences in the lumbar position of users of such a backrest, according to the physical characteristics of each. Without the capacity to adjust the height of a lumbar support for a backrest, the most appropriate and comfortable lumbar support for each user cannot be obtained.

SUMMARY OF THE INVENTION

One object of the present invention is to provide a lumbar support for a backrest which is adjustable according to the physical characteristics of the user.

Another object of the present invention is to provide an improved lumbar support for a backrest which can be adjusted, not only in a horizontal direction, but also vertically according to the needs of a user.

A still further object of this invention is to provide an improved adjustable lumbar support for a backrest having a regulating mechanism for easily controlling both the height of the lumbar support and its position in a horizontal direction.

Additional objects and advantages of the invention will be set forth in the description which follows, and in part will be obvious from the description, or may be learned by the practice of the invention. The objects and advantages of the invention may be realized and obtained by means of the instruments in combinations particularly pointed out in the appended claims.

To achieve the foregoing objects, and in accordance with the invention as embodied and broadly described herein, a lumbar support is provided for a backrest having a lumbar portion designed to be vertically aligned with the lumbar region of a user of the backrest. The lumbar support is ajustable according to an external adjustment setting and comprises, in one embodiment of the present invention, a support plate having front and rear surfaces, at least a portion of the front surface engaging the rear of the lumbar portion of the backrest to define an effective contact region the vertical position of which on the backrest varies with the vertical inclination of the support plate; a first bracket in fixed vertical position relative the backrest, the first bracket pivotally supporting the support plate to permit changes in the vertical inclination of the support plate; a cam rotatably fixed to the first bracket and rotatable to change the vertical inclination of the support plate; and control means for rotating the first cam member by an amount determined by the external adjustment setting, thereby to vertically align the effective contact region with the lumbar region of the user.

Preferably, the backrest has a frame, and the control means comprises a second bracket fixed to the frame; a first shaft rotatably connected to the frame and the second bracket and rotatable by the user of the backrest; a coupler rotatable with the first shaft; and transmission means for converting rotation of the coupler into rotation of the first cam.

The cam includes a plurality of ratchet teeth at the periphery thereof, and the transmission means preferably comprises a cable connected at one end thereof to the coupler, and a pawl attached to the other end of the cable and rotatably mounted on the bracket, the pawl rotating, responsive to an activating force produced in the cable by rotation of the coupler, to engage the ratchet teeth and rotate the cam.

In another aspect of the present invention, the control means further comprises a second shaft rotatably connected to the frame and to the second bracket and rotatable by the user of the backrest, and means responsive to rotation of the second shaft for adjusting the position of the support plate in a horizontal direction. Preferably, the first shaft of the control means is concentric with and rotatable within the second shaft, and the means for adjusting the position of the support plate preferably includes a torsion member attached to the frame of the backrest pivotally supporting the first bracket, the torsion member moving the support plate in a horizontal direction responsive to rotation of the second shaft.

In yet another aspect of the present invention, a lumbar support for a backrest having lumbar portion designed to be vertically aligned with the lumbar region of the user of the backrest and a user operated control means for the lumbar support comprises an inclinable support plate having rear and front surfaces, a portion of the front surface engaging the rear of the lumbar portion of said backrest to define an effective contact region between the support plate and the backrest, the vertical position of the contact region varying with the vertical inclination of the support plate; and means connected between the control means and the rear surface of the support plate for adjusting the inclination of the support plate in response to the control means, to alter the portion of the front surface of the support plate which contacts the rear of the lumbar region and vary the vertical position of the contact region.

BRIEF DESCRIPTION OF THE DRAWINGS

Various features, objects, and advantages of the present invention will be described in connection with the accompanying drawings in which:

FIG. 1 is a perspective view of a seat having a backrest and lumbar support incorporating the teachings of the present invention;

FIG. 2 is a perspective partially cut-way view from the rear of the backrest of FIG. 1;

FIG. 6 is a view of the cam shown in FIG. 4 taken along line 6—6; and

FIG. 7 is a view of the cam of FIG. 6 taken in the direction indicated by arrow 7.

DESCRIPTION OF THE PREFERRED EMBODIMENT

Figure 3:
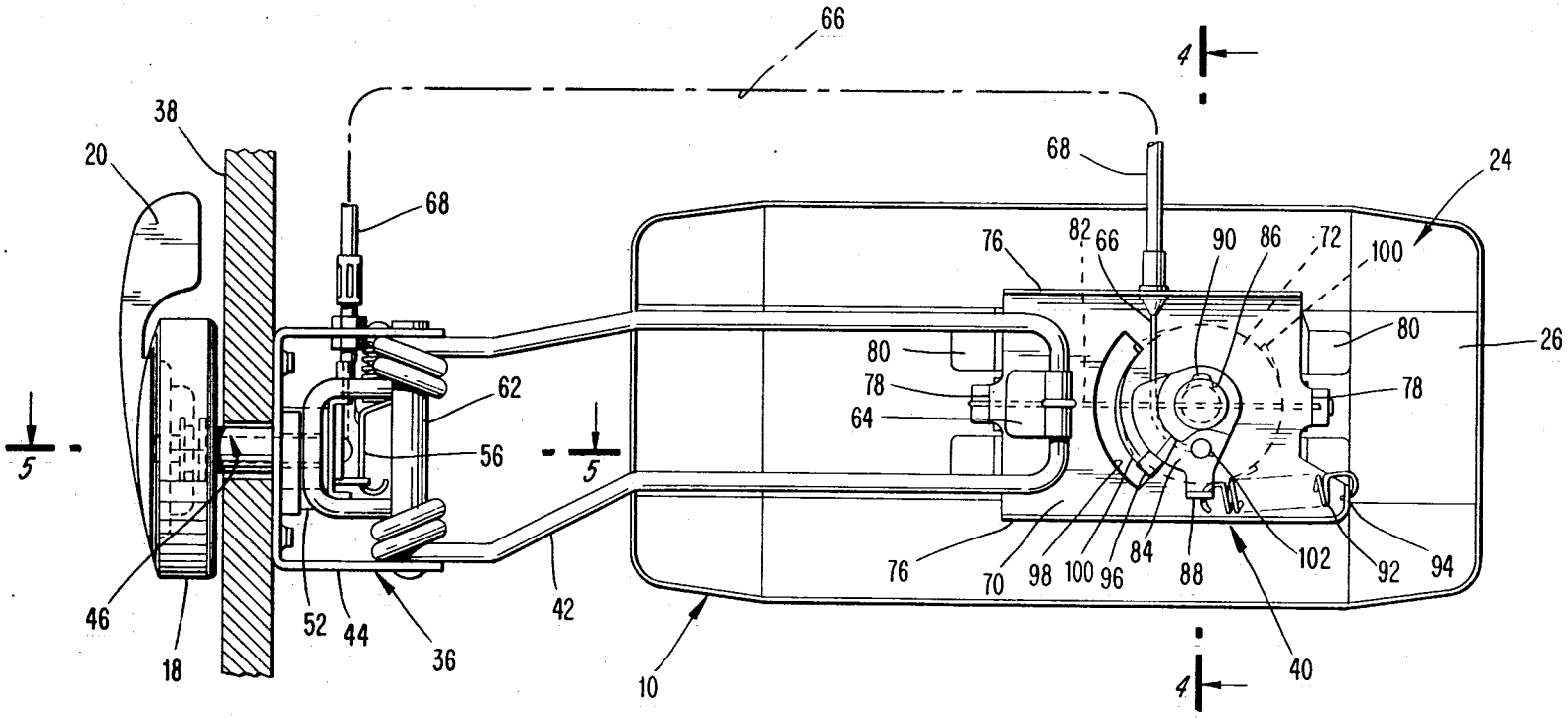
FIG. 3 is a plan view of the lumbar support of FIG. 2.

Referring to FIGS. 1 and 2 together, a lumbar support 10 embodying the teachings of the present invention is shown installed behind a lumbar region 12 within a backrest 14 of a seat 16. Lumbar support 10 affords a user of backrest 14 optimum comfort by permitting adjustment of lumbar support 10 through use of a knob 18 and a lever 20 mounted on a lateral surface 22 of backrest 14. This is accomplished according to the teaching of the present invention by providing for movement of lumbar support 10 in a horizontal direction, as well as by enabling the effective point of contact between lumbar support 10 and the back of lumbar region 12 to be varied in the vertical direction. As best understood by reference in addition to FIG. 4, lumbar support 10 includes a support plate 24 having a rear surface 26 and a front surface 28. Front surface 28 is slightly concave and may preferably include upper surface 30, middle surface 32, and lower surface 34 oriented as shown.

Figure 5:
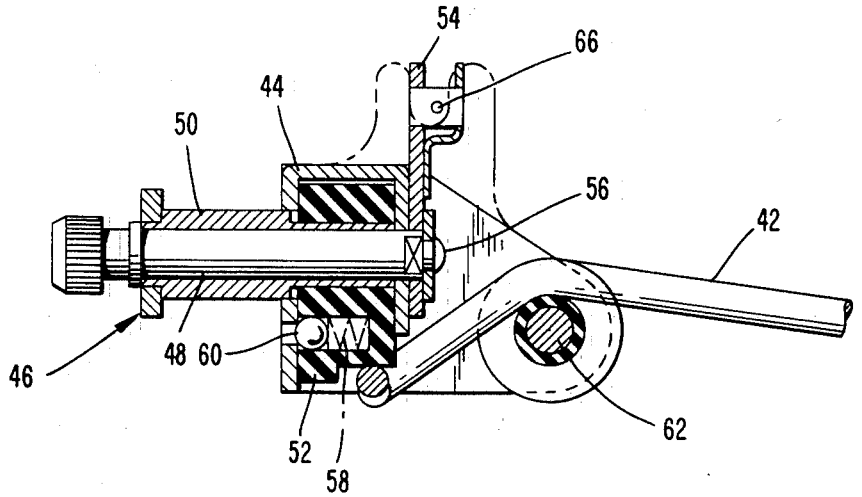
FIG. 5 is a section view of the attaching bracket of FIG. 3 taken along section line 5—5.

In accordance with the present invention, connected between user-operated control means and the rear surface of a lumbar support plate, means are provided for adjusting the inclination of the support plate thereby to alter the portion of the front surface of the plate which contacts the rear of the lumbar region of a backrest, and accordingly to adjust the vertical position of the effective region of support provided by the lumbar support. By way of example and not limitation, lumbar support 10 includes an attaching bracket 36 fixed to a frame 38 of backrest 14 and a support plate bracket 40 rotatably mounted on one end of a torsion spring 42 which is rotatably supported by attaching bracket 36. Viewing FIGS. 3 and 5 together, attaching bracket 36 can be seen to include a casing 44 fixed on a lateral surface of frame 38. A double shaft 46 consisting of coaxial inner shaft 48 and outer shaft 50 rotatably passes through lateral surfaces of backrest 14 and casing 44. Inner shaft 48 is freely rotatable relative to outer shaft 50. A cam member 52 disposed within casing 44 is fixed to an end portion of outer shaft 50, inside frame 38, for rotation therewith. A coupler 54 is fixed to an end portion of inner shaft 48 inside frame 38 by means of a screw 56 for rotation as a lever with inner shaft 48.

Means are provided responsive to rotation of a shaft, such as outer shaft 50, for adjusting the position of a lumbar support plate in a horizontal directon. Outer shaft 50 and cam member 52 are rotated by knob 18 mounted on an outer lateral surface of backrest 44. Cam 52 is maintained at any given position by the action of a compressed spring 58 and a latching ball 60. Torsion spring 42 is wound about a pin 62 fixed in casing 44. One end of torsion spring 42 is in contact with cam member 52, while the other end thereof is fixed to support plate bracket 40 by a curling plate 64. Rotation of cam member 52 has the effect of pivoting torsion spring 42 about pin 62, thereby moving support plate 24 in a horizontal direction. Further details of a mechanism for moving a support plate, such as support plate 24, in a horizontal direction can be found disclosed in U.S. Pat. No. 4,162,807, which is herein incorporated by reference.

A wire cable 66 housed within a cable guide 68 serves to transfer to support plate 24 rotation of lever 20 in one preselected direction, which for the purposes of illustration is taken to be a counterclockwise direction as lever 20 is viewed from the exterior of backrest 14 in FIG. 1. One end of cable guide 68 is attached to casing 44 in a manner to permit the corresponding end of cable 66 to pass through casing 44 and emerge from cable guide 68 for attachment to coupler 54. Lever 20 is fixed to the end of inner shaft 48 exterior to frame 38. As shown in FIG. 3, lever 20 attaches to shaft 48 through an appropriately sized aperture formed in the center of knob 18. Movement of lever 20 in the preselected direction rotates both inner shaft 48 and coupler 54 in a similar direction. The described rotation of coupler 54 draws cable 66 out of cable guide 68 at the end thereof attached to casing 44. In the process, the opposite end of cable 66 is drawing inward toward the corresponding end of cable guide 68.

Figure 4:
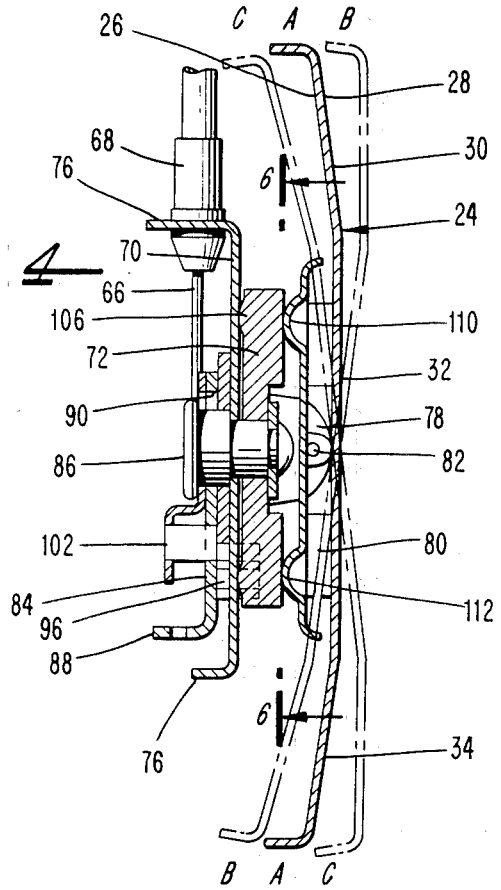
FIG. 4 is a section view of the lumbar support of FIG. 3 taken along section line 4—4.

With reference additionally to FIG. 4, support plate bracket 40 includes a bracket 70 rotatably supported on an end portion of torsion spring 42 and a cam 72 rotatably mounted on bracket 70. The longitudinal edges 76 of bracket 70 are turned away from support plate 24 at right angles to the body of bracket 70. At each end of bracket 70, intermediate each pair of corresponding ends of longitudinal edges 76, are two tabs 78 which are turned toward support plate 24 at right angles to the body of bracket 70. Tabs 78 maintain a space between bracket 70 and support plate 24 in which to accommodate cam 72.

Fixed to a central portion of rear surface 26 of support plate 24 is an attaching plate 80 for connecting support plate 24 and bracket 70. Each end of a hinge pin 82 passes through attaching plate 80 and downturned tabs 78 of bracket 70, so that support plate 24 and bracket 70 are pivotally connected. This permits changes in the vertical inclination of support plate 24, which may therefore assume a variety of vertical dispositions, such as are identified in FIG. 4 by the letters A, B, and C.

In accordance with another aspect of the present invention, there is provided control means for rotating a cam by an amount determined by an external adjustment setting provided by a user. Such control means preferably includes transmission means for converting rotation of a coupler, such as coupler 54 of the present embodiment, into rotation of a cam, such as cam 72. The end of cable guide 68 opposite from casing 44 is attached to one longitudinal edge 76 of bracket 70, and the corresponding end of cable 66 passes through longitudinal edge 76 and emerges from cable guide 68 for attachment to a pawl 84 in a manner to be described below.

Pawl 84 is mounted on the opposite side of bracket 70 from cam 72 for coaxial rotation about the axis of a pin 86. Cam 72 on the side of bracket 70 facing support plate 24 also rotates about the axis of pin 86. As seen in FIGS. 3 and 4, pawl 84 is a fan-shaped plate member having a hook piece 88 extending radially outward from elongated aperture 90 in which pin 86 is received. A tensile spring 92 is attached between hook piece 88 on pawl 84 and an extension 94 of one upstanding edge 76 of bracket 70. Spring 92 is placed in tension by rotation of pawl 84 in a clockwise direction as viewed in FIG. 3. The restoring force of spring 92 biases pawl 84 to return to the position in which pawl 84 is depicted in FIG. 3. When, during operation, pawl 84 does rotate in a clockwise direction as viewed in FIG. 3, a downwardly extending finger 96 formed on the outer periphery of pawl 84 travels within an elongated, circumferential slot 98 formed through bracket 70. In this motion, finger 96 interacts with cam 72 on the opposite side of bracket 70 by engaging any of a number of, for example, four ratchet teeth 100 seen in FIG. 6 to be formed on a periphery of cam 72. The second end of cable 66 is fixed to the upper surface of pawl 84 by means of radially-disposed pin 102.

In operation, when wire cable 66 is drawn to the left, as viewed in FIG. 3, through rotation of lever 20 in a counterclockwise direction as viewed in FIG. 1, pawl 84 is rotated in a clockwise direction as viewed in FIG. 3 against the bias of spring 92. Finger 96 moves within elongated slot 98 catching one of ratchet teeth 100 to rotate cam 72 through an angle of 90°. Release of lever 20 permits spring 92 to return pawl 84 to its original position. This return movement of finger 96 is facilitated through an appropriate elongation of aperture 90 which permits the distance to finger 96 from pin 86 to be increased when pawl 84 has rotated through 90°. The ability to increase the distance between pin 86 and finger 96 allows finger 96 to be drawn in a counterclockwise direction as viewed in FIG. 3 over the next ratchet tooth 100 as finger 96 moves along the periphery of cam 72 during its return movement.

FIGS. 6 and 7 show cam 72 to be provided with a cam face 104 on one side thereof and a central circular aperture 105 for receiving pin 86. A raised annular portion 106 is provided on the surface of cam 72 opposite from cam face 104 for bearing against bracket 70 to facilitate rotation of cam 72 by decreasing the area of contact between cam 72 and bracket 70. Cam face 104 is further provided with a plurality of paired radially-opposed indentations shown by way of example as comprising indentations 108*a*, 108*b*, 108*c*, 108*d*. Indentation 108*a* is formed in the depressed portion of cam face 104, while indentation 108*b* is formed in the elevated portion thereof. Indentations 108*c*, 108*d* are formed in a portion of cam face 104 having an equal elevation medial to the elevation of the areas of cam face 104 in which are formed indentations 108*a*, 108*b*. As shown in FIG. 4 attaching plate 80 is provided with an upper projection 110 and a lower projection 112, both of which are urged against cam face 104.

In operation, upper and lower projections 110, 112 respectively ride up on cam face 104 when cam 72 is rotated and are received in radially opposed vertical pairs of indentations 108*a*, 108*b*, 108*c*, 108*d* in a snapping action. Rotation of cam 72 in addition alters the inclination of cam face 104 with respect to the vertical, which is in turn converted into alteration in the vertical inclination of attaching plate 80 and support plate 24 through the slidable contact maintained with cam face 104 by projections 110, 112.

For example, when indentations 108*c* and 108*d* of cam face 104 are in a vertical relationship one with another, as shown in FIG. 7, the distances between bracket 70 and projecting portions 110, 112, respectively, are equal. Consequently, support plate 24 is maintained in position A shown by the solid line in FIG. 4. In position A the effective contact region of support plate 24 with the back of lumbar region 12 of backrest 14 is at middle face 32 of support plate 24.

On the other hand, if by operation of lever 20, indentations 108*a*, 108*b* assume a vertical relation with one another with indentation 108*b* formed in the elevated portion of cam face 104 receiving upper projecting portion 110 and indentation 108*a* formed in the depressed portion of cam force 104, receiving lower projecting portion 112, the distance between bracket 70 and upper projecting portion 110 is greater than the distance between bracket 70 and lower projecting portion 112. Therefore, support plate 24 is inclined into position B shown in phantom in FIG. 4, and the effective contact region between support plate 24 and the back of lumbar region 12 of backrest 14 is raised, being at upper face 30.

Finally, through operation of lever 20, cam 72 can be rotated so that indentations 108*a*, 108*b* are reversed, assuming a new vertical relationship one with another with indentation 108*b* in the elevated portion of cam face 104 being vertically below indentation 108*a* in the depressed portion of cam face 104. Under these circumstances, upper projecting portion 110 will be received in indentation 108*a* and lower projecting portion 108*b* will be received in indentation 108*b*, so that the distance between bracket 70 and lower projecting portion 112 is greater than the distance between bracket 70 and upper projecting portion 110. As a result, support plate 24 is inclined into position C as shown in phantom in FIG. 4, and the effective contact region of support plate 24 with the back of lumbar region 12 of backrest 14 is lowered, being at lower surface 34.

In the embodiment described above, adjustments in the height of the support applied by support plate 24 to the back of lumbar region 12 are accomplished in three increments. The adjustment can, however, be accomplished in many more increments or continuously by varying the shape of cam face 104, the number of ratchet teeth 100, or the number and location of indentations, such as indentations 108*a*, 108*b*, 108*c*, 108*d*.

It will be apparent to those skilled in the art that modifications and variations can be made in the apparatus of this invention. The invention in its broader aspect is, therefore, not limited to the specific details, representative methods and apparatus, and illustrative examples shown and described. Accordingly, alterations may be made from such details without departing from the spirit or scope of applicant's general inventive concept.

What is claimed is:

1. A lumbar support for a backrest having a lumbar portion designed to be vertically aligned with the lumbar region of a user of the backrest, said lumbar support being adjustable according to a desired adjustment setting operated by regulating means and comprising:

a. a support plate having front and rear surfaces, at least a portion of said front surface engaging the rear of said lumbar portion of said backrest to define an effective contact region, the vertical position of which on said backrest varies with the vertical inclination of said support plate;

b. bracket means in fixed vertical position relative said backrest, said first bracket means pivotally supporting said support plate to permit changes in the vertical inclination of said support plate, said bracket means including a pawl rotatably connected thereto;

c. a cam member disposed between said support plate and said bracket means and rotatably fixed to said bracket means and rotatable to rotate said support plate to change said vertical inclination of said support plate, said cam member having at least one ratchet tooth at the periphery thereof;

d. control means for rotating said cam member by an amount determined by the regulating means to vertically align said effective contact region with said lumbar region of a user said control means also including:

transmission means connected to the regulating means for producing an activating force;

means connected between said transmission means and said pawl for rotating said pawl in response to said activating force produced by said transmission means; and means for engaging said pawl and said at least one ratchet tooth to rotate said cam.

2. A lumbar support, as recited in claim 1, wherein said front surface of said support plate is convex.

3. A lumbar support, as recited in claim 2, wherein said front support plate includes upper, middle and lower front surfaces which each contact the rear of said lumbar portion of said backrest individually to produce said effective contact region in varying vertical support of said lumbar portion.

4. A lumbar support as recited in claim 1, further comprising means responsive to said control means for adjusting the position of said support plate in a horizontal direction; a frame mounted on said backrest; and supporting means movably positioned between said support plate and said frame and connected to said means responsive to said control means.

5. A lumbar support for a backrest having a lumbar portion designed to be vertically aligned with the lumbar region of a user of the backrest, said lumbar support being adustable according to a desired adjustment setting and comprising:

a. a support plate having front and rear surfaces, at least a portion of said front surface engaging the rear of said lumbar portion of said backrest to define an effective contact region the vertical position of which on said backrest varies with the vertical inclination of said support plate;

b. a first bracket means in fixed vertical position relative said backrest, said first bracket means pivotally supporting said support plate to permit changes in the vertical inclination of said support plate;

c. a cam member disposed between said support plate and said first bracket and rotatably fixed to said first bracket and rotatable to rotate said support plate to change said vertical inclination of said support plate;

d. a frame mounted on said backrest; and e. control means for rotating said first cam member by an amount determined by the desired adjustment setting, to align said effective contact region vertically with said lumbar region of a user, said control means including a second bracket fixed to said frame; a first shaft rotatably connected to said frame and said second bracket; a coupler rotatable with said first shaft; and transmission means for converting rotation of said coupler into rotation of said cam.

6. A lumbar support, as recited in claim 5, wherein said cam includes a plurality of ratchet teeth at the periphery thereof and said transmission means comprises:

a. a cable connected at one end thereof to said coupler; and b. a pawl attached to the other end of said cable and rotatably mounted on said first bracket means, said pawl rotating, responsive to an activating force produced in said cable by rotation of said coupler, to engage said ratchet teeth and rotate said cam.

7. A lumbar support, as recited in claim 6, wherein said control means further comprises:

a. a second shaft rotatably connected to said frame and to said second bracket; and b. means responsive to rotation of said second shaft for adjusting the position of said support plate in a horizontal direction.

8. a lumbar support, as recited in claim 7, wherein said first shaft of said control means is concentric with and rotatable within said second shaft; and said means for adjusting the position of said support plate includes a torsion member attached to said frame of said backrest pivotally supporting said first bracket, said torsion member moving said support plate in a horizontal direction responsive to rotation of said second shaft.

9. A lumbar support, as recited in claim 6, wherein said cam is disc-shaped and comprises:

a. a projection extending from a surface of said cam adjacent said first bracket means and engaging said first bracket; and b. a cam face on an opposite surface of said cam.

10. A lumbar support, as recited in claim 9, wherein said control means further comprises:

a. a second shaft rotatably connected to said frame and to said second bracket and rotatable by said user of said backrest;

b. means responsive to rotation of said second shaft for adjusting the position of said support plate in a horizontal direction; and c. supporting means movably positioned between said support plate and said frame and connected to said means responsive to the rotation of said second shaft.

11. A lumbar support, as recited in claim 10, wherein said first shaft of said control means is concentric with and rotatable within said second shaft; and said means for adjusting the position of said support plate includes a torsion member attached to said frame of said backrest pivotally supporting said first bracket means, said torsion member moving said support plate in a horizontal direction responsive to rotation of said second shaft.

12. A lumbar support, as recited in claim 9, further comprising an attaching plate rigidly affixed to said rear surface of said support plate and slidably contacting said cam face.

13. An adjustable lumbar support for a backrest, as recited in claim 12, wherein said attaching plate is provided with a plurality of projections for effecting sliding contact with said cam face.

14. An adjustable lumbar support for a backrest, as recited in claim 13, wherein said cam face is provided with a plurality of indentations for receiving said projections of said attaching plate.

* * * * *